United States Patent [19]

St. Charles

[11] Patent Number: 5,038,997

[45] Date of Patent: Aug. 13, 1991

[54] WATER RESISTANT PAPERBOARD AND METHOD OF MAKING SAME

[75] Inventor: F. Kelley St. Charles, Fisherville, Ky.

[73] Assignee: Brown & Williamson Tobacco Corporation, Louisville, Ky.

[21] Appl. No.: 485,024

[22] Filed: Feb. 26, 1990

[51] Int. Cl.[5] ..... B65D 5/62

[52] U.S. Cl. ..... 229/3.1; 162/158; 129/3.5 R; 428/511

[58] Field of Search ..... 229/3.1, 3.5 R; 162/158, DIG. 3; 428/511, 512, 530

[56] References Cited

U.S. PATENT DOCUMENTS

| | | | |
|---|---|---|---|
| 2,683,087 | 7/1954 | Reynolds, Jr. | 162/158 |
| 2,957,797 | 10/1960 | Nakayama | 162/158 |
| 3,096,228 | 7/1963 | Day et al. | 162/158 |
| 3,485,575 | 12/1969 | Christian | 162/158 |
| 3,936,339 | 2/1976 | Lock et al. | 428/530 |

*Primary Examiner*—Gary E. Elkins
*Attorney, Agent, or Firm*—Charles G. Lamb

[57] ABSTRACT

A paper sheet of paperboard, such as boxboard, cardboard and the like has one surface coated with a surfactant to prevent, or at least retard the penetration of moisture through the thickness of the paperboard to the other surface thereof. A method of making a paper sheet or paperboard which has an improved resistance to or retards the penetration of moisture through the thickness of the paperboard comprises the sequential steps of applying a thin coating of a surfactant to one surface of the paperboard, and immediately drying the coated surfactant on the paperboard.

3 Claims, 1 Drawing Sheet

WATER RESISTANT PAPERBOARD AND METHOD OF MAKING SAME

BACKGROUND OF THE INVENTION

1. Field of the Invention

The present invention is related to paper products such as paperboard and the like, and more particularly to paperboard having improved resistance to moisture penetration therethrough, and a method of making same.

2. Background of the Invention

The term "paperboard" will be used herein as meant in a generic sense for all forms of paper products such as cardboard, boxboard, etc.

A well recognized problem with paperboard is its propensity to absorb moisture. This is a particularly important drawback in the use of paperboard for article containers.

Various solutions have been proposed which renders the paperboard impervious to moisture. For example, U.S. Pat. No. 3,107,837 teaches the wicking and bleeding problems of paperboard, and provides a solution which uses a coating of impervious material, such as polyvinyledine chloride, on the interior surface of a paperboard carton to form a moisture barrier. U.S. Pat. No. 3,328,189 teaches preventing wicking of wwater through a paperboard container by applying a layer of perfluoroalkylmonocarboxylic acid on the inside of a carton blank to form a moisture barrier. U.S. Pat. No. 4,075,372 teaches applying a flexible precoat of a thermoplastic resin of polyvinyl acetate, ethylene vinyl acetate, ethylene vinyl chloride, and then applying a lacquer over the precoat to form a moisture barrier. U.S. Pat. No. 4,198,267 teaches a process for manufacturing paper pulp by adding a composition to the pulp slurry which includes finely divided hydrophobic lubricating particles such as silica, or wax in a hydrocarbon oil carrier liquid, and a minor quantity of a surfactant to assist in spreading the carrier in the aqueous slurry to enhance the distribution and penetration of the lubricating particles in the slurry. U.S. Pat. No. 4,207,142 teaches the use of various paper sizing agents which can be either mixed within the paper pulp from which paper is later made, or to the surface of the paper after it is made. And, U.S. Pat. No. 4,597,831 teaches a method of sizing a paper sheet to render the paper sheet less absorbent to water by applying a foam of rosin the paper surface.

SUMMARY OF THE INVENTION

The present invention provides a method for treating paperboard with a surfactant to retard the penetration of moisture through the thickness of the paper board.

The present invention also provides a paperboard having a thin coating of a surfactant to retard the penetration of moisture through the thickness of the paperboard.

The present invention further provides a container fabricated of paperboard having the interior wall surfaces coated with a surfactant to retard the penetration of moisture through the thickness of the paperboard container walls.

BRIEF DESCRIPTION OF THE DRAWINGS

A better understanding of the present invention will be had upon reference to the following description in conjunction with the accompanying drawings wherein like numerals refer to like features and in which.

DETAILED DESCRIPTION OF THE PREFERRED EMBODIMENTS

Figure 1:
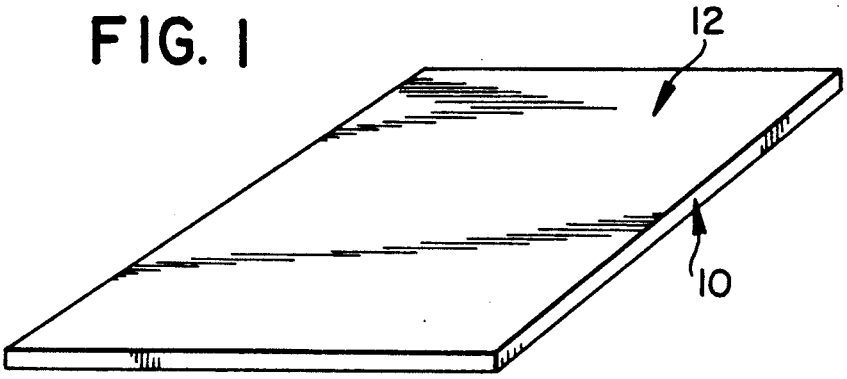
FIG. 1 is a perspective view of a paperboard sheet of the present invention; and, FIG. 2 is a perspective view, partially in cross-section, of a paperboard container of the present invention.

With reference to FIG. 1, there is shown a paperboard sheet 10 having a thin coating 12 of a surfactant on one of its surfaces. Generally, cationic, anionic, and nonionic surfactants as well as amphoteric surfactants work well in the present invention.

Figure 2:
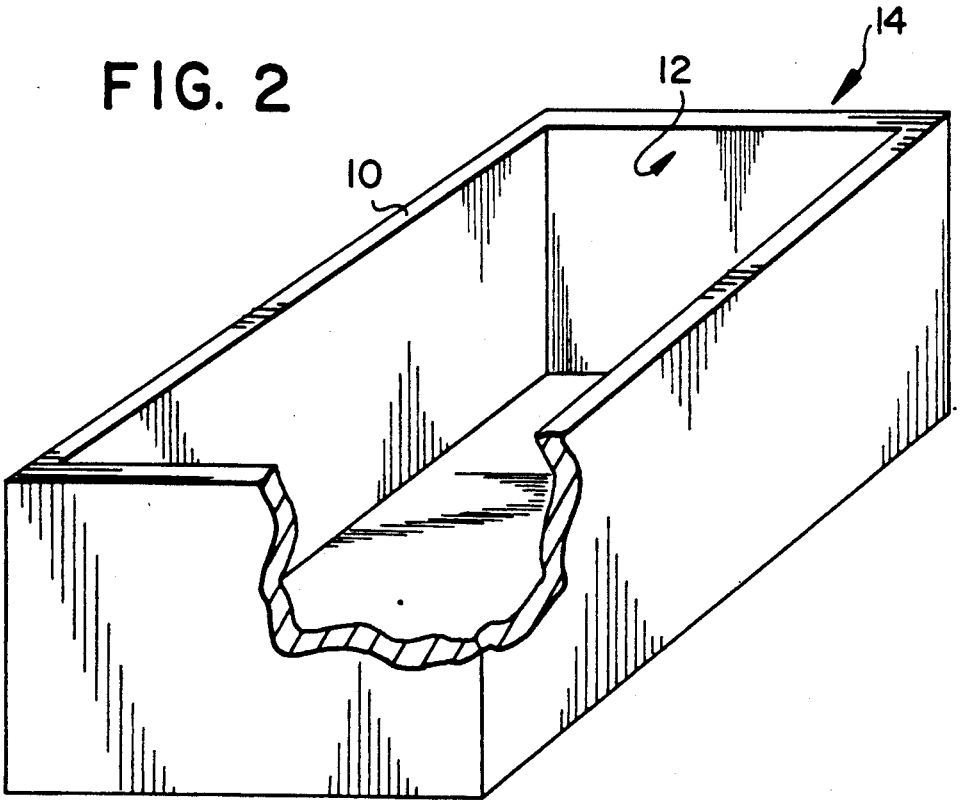

With reference to FIG. 2, there is shown a container 14 which is fabricated of a paperboard material such as the paperboard sheet 10 of FIG. 1. The paperboard sheet is folded to form the walls of the container 14 such that the surface of the sheet 10 having the coating 12 is the interior wall surface of the container 14.

The surfactant coating 14 is applied to the paperboard 10 by applying a thin layer of the surfactant to one surface of the paperboard, and then immediately drying the coated surfactant on the paperboard to keep the surfactant on the surface to which it is applied. Various examples of the present invention were tested.

EXAMPLE 1

Three different sample dilute surfactant solutions were prepared by diluting a commercially available surfactant in water to form specific weight percent solutions. The following were the samples prepared:

(1) Sample 1: 1% Triton X -45- (Rohm & Haas) in water, which is a octoxynol a nonionic surfactant. (2) Sample 2: 1% Sodium Carboxymethyl Cellulose in water. (3) Sample 3: 1% Triton X -45and 1% Sodium Carboxymethyl Cellulose CMC in water.

Each of the three samples of dilute surfactant solutions was printed of one surface of different paperboard sheet with a gravure cylinder having a 30 micron cell depth and dried.

Next, drops of 57% (weight-weight) potassium citrate in water were applied to the coated surface of the paperboard sheet, and also to an uncoated paperboard sheet as a control. The drop sizes were 5, 10, and 25 microliters. The paperboard sheets were then placed in a humidity cabinet at 69% relative humidity to prevent the drops from evaporating.

After about 24 hours, the paperboard sheets were removed from the humidity cabinet, and observations of the uncoated surface of the paperboard sheets were made to determine the effect of the surfactant.

The paperboard sheets coated with surfactant samples 1 and 3 did not show any distortion to the uncoated surface, and the coated surface was slightly swelled, but had a dry appearance. The paperboard sheet coated with sample 2 had a wet or greasy appearing spot on the uncoated surface. The uncoated control paperboard also had a wet or greasy appearing spot on the surface thereof opposite to the surface upon which the drops were deposited.

EXAMPLE 2

Surfactant sample 1 was printed on one surface of two different paperboard sheets with a gravure cylinder and dried.

Next, drops of 57% (weight-weight) potassium citrate in wate were applied to the coated surface of one of the paperboard sheets and to one surface of an uncoated control paperboard sheet, and drops of a saturated potassium citrate were applied to the coated surface of the other one of the paperboard sheets, and to one surface of another uncoated control paperboard sheet. The drop volumes of the 57% potassium citrate and the saturated potassium citrate were 0.05 cc, 0.10 cc, 0.15 cc, and 0.30 cc.

The paperboard sheets having the drops of 57% potassium citrate was placed in a humidity cabinet at 69% relative humidity to prevent the drops of 57% potassium citrate from evaporating, and the paperboard sheets having the drops of saturated potassium citrate solution were placed in a humidity cabinet at 62.5% relative humidity to prevent the drops of saturated potassium citrate from evaporating.

After about 48 hours, the paperboard sheets were removed from the humidity cabinets, and observations of the uncoated surface of the paperboard sheets were made to determine the effect of the surfactant.

The uncoated paperboard control sheets both showed large coherent spots of potassium citrate solution on the opposite side thereof to which the drops had been applied. & With the coated paperboard sheet upon which drops of saturated potassium citrate solution were applied, the potassium citrate drops of 0.05 cc, 0.10 cc, and 0.15 cc showed no evidence of having penetrated through the paperboard sheet to the uncoated surface. The potassium citrate drop of 0.30 cc showed some small distortion on the uncoated surface, but not the large coherent spots evident on the untreated paperboard control sheet.

With the coated paperboard sheet upon which drops of 57% potassium citrate were applied, the potassium citrate drops of 0.05 cc, and 0.10 cc showed no evidence of having penetrated through the paperboard sheet to the uncoated surface. The potassium citrate drops of 0.15 cc and 0.30 cc showed some small distortion on the uncoated surface, but not the large coherent spots evident on the untreated paperboard control sheet.

From the foregoing, it is clear that contrary to what would have been expected, the surfactant coating prevented or at least retarded the penetration of moisture through the thickness of the paperboard. It is contemplated that the surfactant causes the moisture or liquid to be preferentially wicked along the surface fibers of the paperboard material, thus, preventing or at least retarding penetration of the moisture through the paperboard sheet. The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A paperboard sheet comprising a thin coating of surfactant on one surface thereof, said surfactant extending only partially through said paperboard.

2. A container fabricated of paperboard comprising a thin coating of a surfactant on one surface of a wall of the container, said surfactant extending only partially through said paperboard.

3. The container of claim 2, said container having interior wall surfaces wherein the interior wall surfaces are coated with a surfactant.

* * * * *